US006959858B2

(12) United States Patent
Stagnaro

(10) Patent No.: US 6,959,858 B2
(45) Date of Patent: Nov. 1, 2005

(54) MAIL RECEPTACLE

(75) Inventor: Brent Joseph Stagnaro, Arlington, VA (US)

(73) Assignee: Brent Stagnaro, Arlington, VA (US)

( * ) Notice: Subject to any disclaimer, the term of this patent is extended or adjusted under 35 U.S.C. 154(b) by 0 days.

(21) Appl. No.: 10/600,366

(22) Filed: Jun. 23, 2003

(65) Prior Publication Data

US 2004/0256449 A1 Dec. 23, 2004

(51) Int. Cl.[7] ..... A47G 29/12
(52) U.S. Cl. ..... 232/19; 232/45
(58) Field of Search ..... 232/19, 28, 17, 232/45, 38; 220/476, 478

(56) References Cited

U.S. PATENT DOCUMENTS 432,254 A * 7/1890 Taylor ..... 232/19
473,138 A * 4/1892 Anderson ..... 232/28
476,139 A * 5/1892 Faw ..... 232/19
2,229,646 A * 1/1941 Firestone ..... 220/6
3,802,620 A * 4/1974 Ferrara ..... 232/19
5,897,053 A * 4/1999 Cirimele ..... 232/19

* cited by examiner

*Primary Examiner*—William L. Miller

(57) ABSTRACT

The invention is attached in front of and beneath a mail opening and as the mail passes through the opening it comes into contact with a face-plate provided by the unit. The reaction from the mail pushing against the face-plate rotates sliding plates producing an enlarged collection area from which the recipient can retrieve such mail. The face-plate can then be pushed into its upright position for the next mail delivery. The plates are pivoted at the base of the unit making them rotate around a common centerline. They are engaged in a manner, which allows them to slide past one another until such a point in rotation that one will stop and hold the adjacent plate in succession. The design enables the unit to automatically collapse upon contact with an adjacent wall when the door on which the unit is attached opens, allowing the door to open fully.

8 Claims, 3 Drawing Sheets

MAIL RECEPTACLE

CROSS-REFERANCE TO RELATED APPLICATIONS

Not Applicable

FEDERALLY SPONSORED RESEARCH OR DEV.

Not Applicable

REFERENCE TO SEQUENCE LISTING

Not Applicable

BACKGROUND OF THE INVENTION

This invention relates generally to receptacles, and more particularly to the type, which receives mail inserted through an opening provided at a door, wall or other related partition. There have been several patents in the past to alleviate the burden of a floor cluttered with mail and the like beneath said opening.

With respect to U.S. Pat. No. 3,802,620 which has been described as a simple frame of two U-shaped members hinged together with cloth forming the basket and supported by chains on either side from the face of the door. This art is cumbersome to the user's ability to enter and exit through the door since the devise must remain fully open at all times to receive mail. This art also does not contain deep sides for which to contain the mail allowing the possibility for the articles to spill out onto the floor.

With respect to U.S. Pat. No. 2,229,646 it is described as having suction cups for which to adhere to a door thus limiting the type of door this invention can be mounted. Although this devise expands to collect mail, it fails to provide for the need to automatically collapse when the door is in use, thus, hindering the handicapped. In addition, it is probable that articles passed through the door could over shoot the top of the devise allowing the mail to fall to the floor since the device hinges its success on chance rather than a device to direct the mail into its collection chamber.

Other prior art such as U.S. Pat. No. 0,179,761 lacks easy access to retrieve its contents and requires complex attachment to the mail slot. The submitted invention takes all of these problems into account with respect to its overall design.

BRIEF SUMMARY OF THE INVENTION

In general, this invention is to receive and retain mail in a collection area as it passes through a mail opening and thus prohibiting it from striking the floor. This invention clearly accomplishes this basic idea and provides many additional amenities for the user. Any mail passing through the opening will fall into an expanding collection area due to the art of providing a face-plate extended up in front of the slot for the mail to strike.

Once the mail strikes and pushes against the face-plate a chain reaction of events is initiated. The face-plate begins to rotate about a common pivot point at the base of the box. Inter-locking plates begin to slide past each other creating an expanding plane on two sides of the receiving area between which the mail is to be collected. The side plates are engaged in a manner which allows them to slide past one another while remaining inter-locked until such a point in rotation when one will stop and hold the adjacent plate in succession until all of the side-plates and the face-plate are extended away from their original collapsed position. The collection area, while expanded, is then able to automatically collapse when the door on which the invention is attached is opened which is a great advantage for handicap accessibility requirements and general convenience to the user. In addition, this devise further helps the handicapped since nothing on the receptacle has to be turned, lifted, or pushed to retrieve the mail and articles from the unit.

Another advantage this invention gives to the handicapped is its slender profile. When closed the unit is only a few inches from the inside face of the door allowing a user in a wheelchair to open and leave through the door easily.

This invention also provides additional security for the user. The unit has permanent sidewalls, which flank the opening of the mail slot preventing a burglar from reaching through the slot with a devise and unlocking the door.

DRAWING REFERENCE NUMERALS

1. Encasement plate.
2. Side-plate
3. Contiguous plate.
4. Bottom panel.
5. Face-plate
6. Back panel
7. Screw
8. Mail opening.
9. Guide.
10. Pivot point
11. Door/Wall/partition.
12. Mail in motion.
13. Bolt, rod, rivet, pin or the like.
14. Spacer, washer, or filling piece.
15. Extension piece.
16. Opening.
17. Curved or rounded edge.

DETAILED DESCRIPTION OF THE INVENTION

Figure 3:
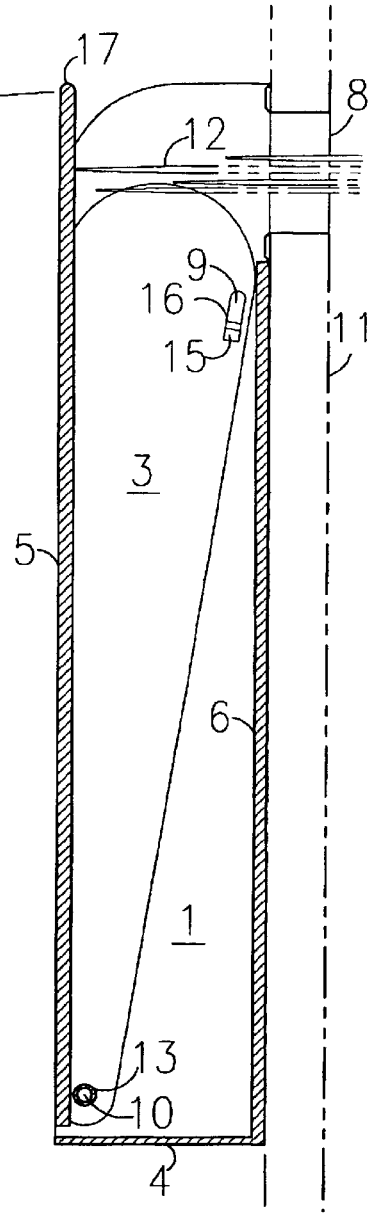
FIG. 3 is a section through the invention in the collapsed position.
Figure 4:
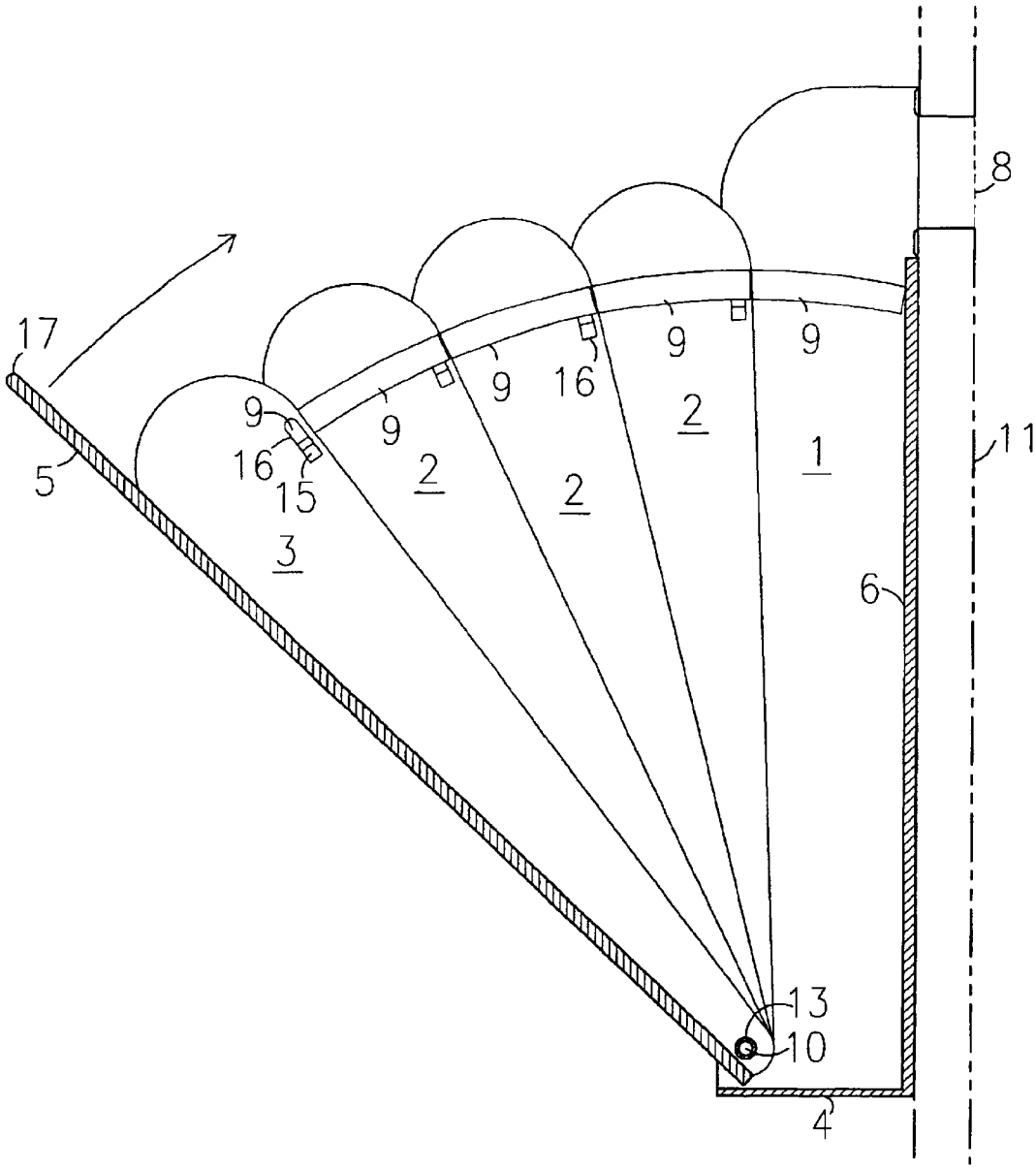
FIG. 4 is a section through the invention in the extended position.

Referring to the drawings and the art of the invention in greater detail, the receptacle is mounted to a wall or to a door #11 underneath a mail opening #8 poised to receive mail #12 or other articles as shown in FIG. 3. When the mail #12 passes through the opening in a door #8 by the mail carrier the mail comes into contact with the inside portion of the face-plate #5 being so located as to be directly in front of and equal to the top of the mail slot. The force of the mail #12 pushing against the face-plate #5 causes it to rotate symmetrically about a pivot point #10 located at the base portion of the receptacle. This pivot point is provided by the means of a bolt, rod, rivet, pin #13, or other means common with the art capable of rendering an equal result.

A fixed side-plate #3 and it's opposite are attached, contiguous, or concurrent to that of the face-plate as to make them one piece. These contiguous side-plates are flanked perpendicularly to that of the face-plate and have a similar shape to that of the inter-locking side-plates #2.

Side-plates #2, the contiguous plate #3 and their opposites are extensible, collapsible, and are able to repeatedly create, maintain, and return a staggered plane between which mail and other articles are retained, as shown in FIGS. #1 and #4. These plates are so related as to be inter-locked, as for example, engaged with each other by overlapping and interpenetrating of alternate projections and recesses. And are joined together in such a manner that force applied to one part affects all parts. They have a shape of a larger rounded or curved upper end, converging side edges and a smaller diameter narrower rounded end as shown in FIGS. #3 and #4. Let it be understood that the rounded shape at the top of the plates can be ornamentation and can take on a variety of shapes while the receptacle will function normally. The rod's #13 relation to the side-plates, contiguous plate and their opposites is such that they are allowed to freely rotate while maintaining their position about the pivot point #10 created by the rod #13.

Figure 1:
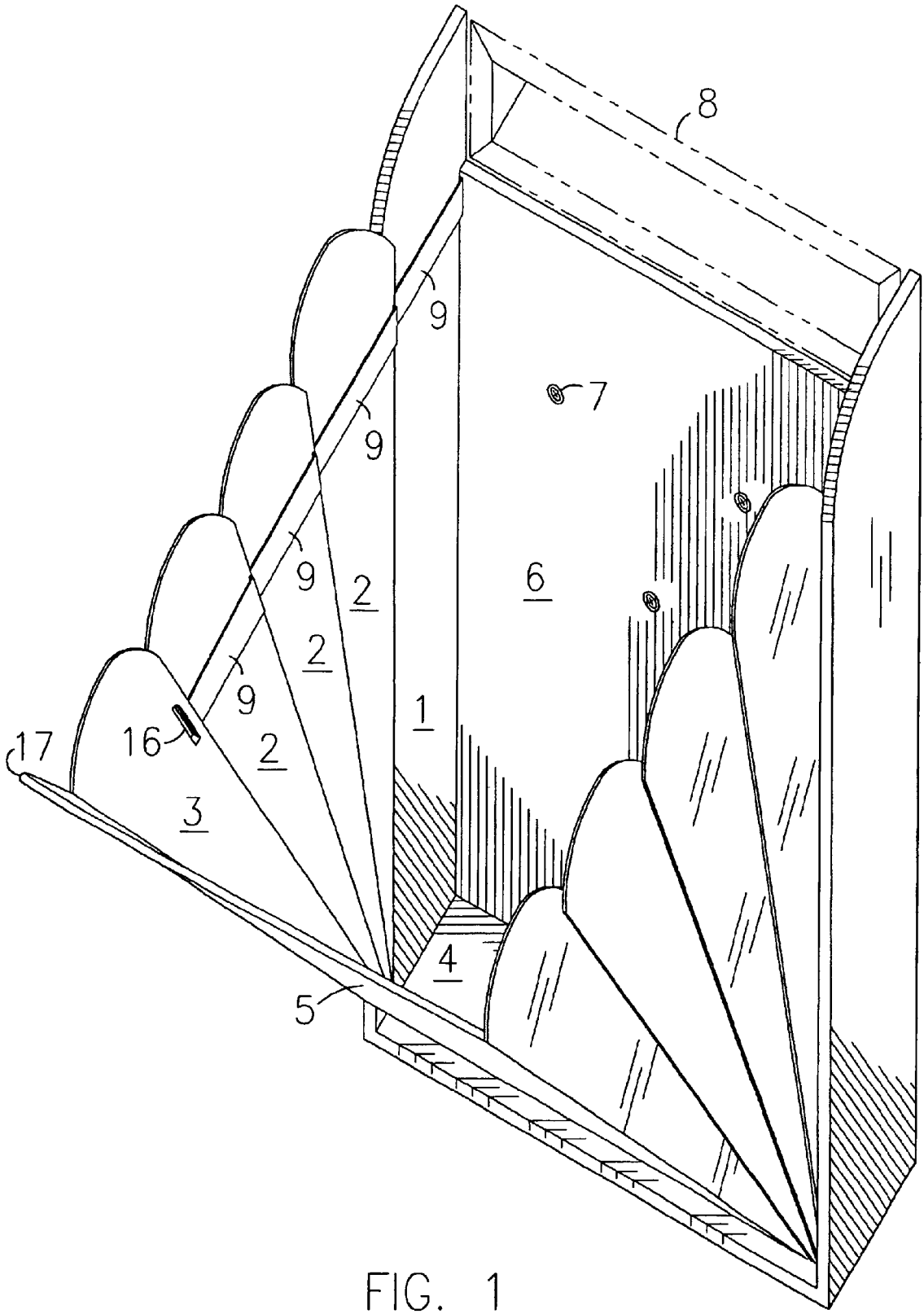
FIG. 1 is an axonometric of the invention in the expanded position.

The inter-locking arrangement of plates #2 and #3, the encasement plate #1, and their opposites provides guidance and support while they rotate about the pivot point #10 established at the base of the receptacle. This inter-locking arrangement is such that each side-plate #2 has its own guide #9 located on one side of the plate and an extension piece #15 located on the other. The encasement plate #1 also has a guide #9 located on the side of its wall but lacks the extension piece #15 since it is not needed. The contiguous plate #3 has an extension piece #17 on the side of its plate but lacks the guide #9 since it is also not needed. Each plate in the series of plates will eventually hold in position and limit the rotation of the adjacent plate do to the design of the guide #9 and the placement of the extension pieces. The extension piece of one plate is so located as to be contained between the guide #9 and the inside surface of the adjacent plate. The first side-plate #2 in the series of side-plates engages its extension piece #15 between the encasement plate's guide and the surface of the encasement plate #1 thus beginning the series and providing the necessary structural support for the plates while they are extended as shown in FIGS. 1 and #4.

Figure 2:
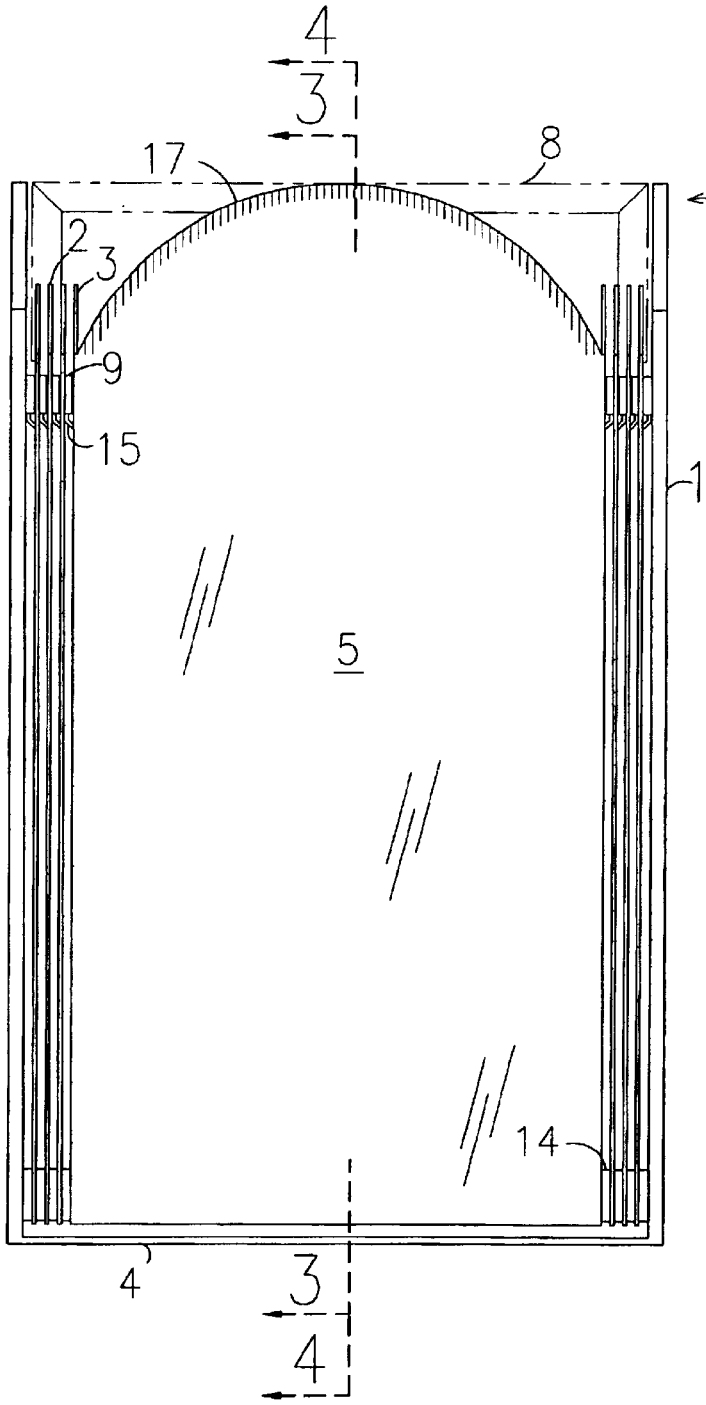
FIG. 2 is a front elevation of the invention in the collapsed position.

The guide #9 is attached to the surface of each of the side-plates #2 and encasement plate #1 at two end points creating and maintaining an area for the extension piece #17 to be contained. In elevation, as in FIG. 2, the shape of the guide #9 lends itself to that of an arc of a circle since the parts are in rotation about a central pivot point, which is demonstrated in the preferred embodiment. The guide #9 also lends itself to being parallel to the side-plate #2, which is also demonstrated, in the preferred embodiment. The sectional profile of the guide #9 can take several shapes. A rectangular sectional profile is exhibited in the particular preferred embodiment.

The extension piece #17, which extends itself from the side of plates #2 and #3, can be made in several ways. In the particular preferred embodiment the invention uses the method of pressing the side of the plate as to punch the shape of the extension through the material so to keep it unified, whole, and continuous creating an opening #18 in the side of the plate. The extension piece is pressed as to allow it to pass between the guide #9 and the plate as described above.

The encasement plate #1 in FIG. #4, extends up equal to the top of the opening #8 so to help direct the mail #13 as it enters and travels through the opening. The depth of the encasement plate in the particular preferred embodiment does not extend far from the face of the door as to minimize the sectional profile of the receptacle but this may vary do to the purchaser's needs and should not restrict the overall intent of the invention.

The back panel #6 is attached to the encasement plate #1 and bottom panel #4 and aids in providing a plane for which to contain the mail #12 and other articles especially if the partition #11 to which the receptacle is mounted to does not have a continuous flat surface. The demonstrated preferred embodiment assumes this to be the condition. Openings are then placed through the back panel, which allow screws to pass through so to anchor the receptacle to the partition #11. In the particular preferred embodiment this is provided by the means of a screw #7 as shown in FIG. #1 but may vary depending on the composite material of the partition #11. The bottom panel #4 is the same width as that of the encasement plate #1 and extends the length of the back panel #6 maintaining a continuity about the area retaining the mail #12 as shown in FIG. #3.

In elevation the face-plate #5 is arced at the top portion and its apex is at lease equal to the top height of the mail opening as shown in FIG. #2 allowing it to come into contact with the mail #12 as the mail #12 passes through the opening as shown in FIG. #3. The edge #17 of the arced portion at the top of the face-plate #5 has the shape of being curved. The ability to contract the expanded receptacle is based on several mechanical devises inherent in the design of the receptacle the first of which is the arced shape design of the upper portion of the face-plate #5. As the door is opened, the face-plate #5 comes into contact with an adjacent wall or surface and the differing geometries of a flat surface and the angled arced plane of the receptacle reduces the friction allowing the face-plate #5 to slide against the surface.

The second inherent mechanical devise allowing the receptacle to collapse is that of the design of the inter-locking side plates. Thou they are held in place as they rotate about the pivot point #10 they are free to rotate in the opposite direction until such a point as they are fully collapsed.

The face-plate #5 and all of its components can be made out of many different types of materials and or alloys some of which are wood, cast iron, bronze/brass, plastic, steel, and a variety of sheet metal.

As illustrated in FIG. #3 when the unit is fully collapsed plates #2 and #3 are fully enclosed within the area of the encasement plate #1. The rod's placement #13 is a centric about plates' #2 and #3 center of gravity as the plates lean against the back panel #6 of the receptacle maintaining that while the receptacle is not in use it remains in the collapsed position and does so while the door is in use. At the base of the unit located between the plates #2, #3, and the encasement wall #1 are filling-pieces, spacers, or washers #16 as shown in FIG. #2. The purpose of #16 is to maintain a parallel adjacency among the components as shown in FIG. #2.

I claim:

1. A receptacle mounted in front of and below an opening through a door, wall, or related partition to receive mail comprising of a face-plate located in front of the mail opening of which the mail is to come into contact with, thus causing the face-plate and side-plates to rotate about a pivot point provided by a rod located adjacent a bottom the receptacle;

and the face-plate, the side plates, and encasement plates being so related to one another as to be inter-locked in a manner that allows the side-plates and face-plate to move past one another while maintaining the ability to stop and hold in a rotated position about said rod thereby creating planes between which to retain the mail in a mail collection area, the side plates and face-plate inter-locked to and supported by the encasement plates which flank the side plates of the receptacle and the mail opening which are attached to the bottom and back panel.

2. The receptacle as defined in claim 1, comprising of the collection area able to expand when mail the strikes the face-plate.

3. A receptacle mounted underneath, on one side of, attached in front of, and about an opening through a door, wall, or related partition to receive mail comprising of a face-plate containing in part or in full the shape of an arc and being so located as to be in front of and extending to the top of the mail opening, the mail coming into contact with the face-plate thus causing it and side-plates to rotate about a pivot point provided by a rod located adjacent a bottom at the base of the receptacle;

and the face-plate, the side plates, and encasement plates being so related to one another as to be inter-locked in a manner that allows the side-plates and face-plate to move past one another while maintaining the ability to stop and hold in a rotated position about the pivot point thereby creating planes between which to retain the mail in a mail collection area, the side plates and face-plate; inter-locked to and supported by the encasement plates which flank the side plates of the receptacle and the mail opening and which are attached to the bottom and back panel.

4. The receptacle as defined in claim 3, comprising of the collection area able to collapse when force is applied to; or as the face-plate strikes an adjacent surface.

5. The receptacle as defined in claim 3, comprising of a guide or guides and extension piece or pieces engaged with one another as to have the extension piece of one of the side plates be placed within an area in whole or partially confined by the adjacent side plate's guide so as to inter-lock the plates.

6. The receptacle as defined in claim 3, wherein the rod is in an a centric positioning to the side plates' center of gravity when the side plates are collapsed, extended or in a stationary position about the rod.

7. The receptacle as defined in claim 3, comprising of an angle of that of the face-plate to that of the back panel when expanded is such that the mail will not fall out of the collection area while maintaining the ability to collapse the collection area upon contact with the adjacent surface.

8. A method for automatically expanding a mail collection receptacle to receive mail as it enters through an opening provided at a door, wall or related partition comprising of the steps of: the mail striking a face plate of the receptacle located in front of the opening; the mail pushing against said face-plate with force causing it to rotate about a pivot point, thus causing the face-plate and inter-locking side-plates of the receptacle to move past one another and hold one another thereby creating planes between which to retain said mail in a mail collection area.

* * * * *